United States Patent [19]

Martin et al.

[11] Patent Number: 4,648,639

[45] Date of Patent: Mar. 10, 1987

[54] APPARATUS AND METHOD FOR A SECURITY LOCK

[75] Inventors: Eugene W. Martin, Salt Lake City; Robert J. Martin, Bountiful, both of Utah

[73] Assignee: Interwest Import & Export Company, North Salt Lake, Utah

[21] Appl. No.: 752,369

[22] Filed: Jul. 3, 1985

[51] Int. Cl.[4] ..... E05C 1/16; E05B 55/10

[52] U.S. Cl. ..... 292/167; 292/153; 292/DIG. 26; 292/DIG. 27; 70/472

[58] Field of Search ..... 292/167, 153, 173, 169.14, 292/169.15, 169.17, DIG. 26, DIG. 27; 70/472

[56] References Cited

U.S. PATENT DOCUMENTS

| | | | |
|---|---|---|---|
| 753,783 | 3/1904 | Young | 292/169.14 |
| 1,498,802 | 6/1924 | McRae et al. | 292/DIG. 27 |
| 1,994,104 | 3/1935 | Kebort | 292/354 |
| 2,164,290 | 6/1939 | Hurd | 292/DIG. 26 |
| 2,326,635 | 8/1943 | Gold et al. | 292/167 |
| 2,580,237 | 12/1951 | McConnell | 292/153 |
| 2,702,204 | 2/1955 | Collier | 292/169 |
| 2,723,874 | 11/1955 | Hillgren | 292/336.3 |
| 2,973,216 | 2/1961 | Gilmore et al. | 292/280 |
| 3,695,662 | 10/1972 | Ploughman | 292/DIG. 26 |
| 3,791,686 | 2/1974 | Horozawa | 292/DIG. 26 |
| 3,804,441 | 4/1974 | Kobayashi | 292/DIG. 26 |
| 4,108,482 | 8/1978 | Dietrich et al. | 292/DIG. 27 |
| 4,312,205 | 1/1982 | Reed et al. | 70/472 |

FOREIGN PATENT DOCUMENTS

| | | | |
|---|---|---|---|
| 0030984 | 7/1981 | European Pat. Off. | 292/173 |

*Primary Examiner*—Leslie A. Braun
*Assistant Examiner*—John M. White
*Attorney, Agent, or Firm*—Workman, Nydegger & Jensen

[57] ABSTRACT

A security lock comprising a latch positioned at the edge of a door which is actuated to selectively lock or unlock the door. The security lock includes an optional key-actuated dead bolt which can provide additional security when needed. A mechanism for locking or unlocking the latch comprises a hand-actuated knob positioned on the inside of the door so that when the dead bolt is not in use, the latch mechanism may still be locked or unlocked simply by rotating the knob between two positions. The mechanism for locking the latch is disengaged when the latch is in the locked position. If the latch is in the locked position when the door is opened, when the door is closed the latch is automatically unlocked to prevent a person from accidentally being locked out.

27 Claims, 8 Drawing Figures

APPARATUS AND METHOD FOR A SECURITY LOCK

BACKGROUND

1. The Field of the Invention

The present invention relates to security locks for securing entry into a dwelling, and in particular, to a security lock which provides a locking mechanism in combination with an optional dead bolt, and wherein the locking mechanism is actuated from inside without having to use a key, and wherein the locking mechanism has an automatic unlocking feature to prevent accidental lockout when leaving the dwelling.

2. The Prior Art

Security locks are often installed in doors to provide a secure locking mechanism, especially for use during the nightime or when added security is desired. For this purpose, many key-actuated security locks have been developed in the prior art. Key-actuated locks are typically locked by simply inserting the key and turning it to move the locking mechanism into the locked position. However, such key-actuated locking mechanisms have some major drawbacks.

For example, if the need arises to exit the dwelling quickly, such as in the case of fire, it may be difficult to locate the key so that the door may be opened. Or, even if the key is located, the time required for inserting the key and unlocking the security locks may be critical if danger is imminent. Such problems are further complicated when the individuals within the dwelling are small children, older persons, or handicapped persons for whom it may be difficult to locate the key and to unlock the door when time is of the essence.

Another problem which is frequently encountered with many prior art security locks is their inability to withstand tampering and their susceptibility to being forced and structurally damaged by thieves or others who might desire to gain entry. Typically, when a security lock is locked, the door handle is also locked into position. Thus, a thief having the proper tools may be capable of placing enough torque or force on the door handle so as to force the handle, thereby forcing and breaking the locking the mechanism within the door. If sufficient force can be applied to the locked door handle so as to force the handle to rotate, the locking mechanism may be damaged to the point of allowing entry.

Still another problem of some prior art security locks is the potential for locking oneself out of a dwelling. Many locks, when in the locked position, allow the door to be opened from the inside, but not from the outside. Hence, if a person opens and shuts the door behind him without remembering the key, the person finds himself locked out.

BRIEF SUMMARY AND OBJECTS OF THE INVENTION

What is needed in the art is a security lock which is not necessarily key-actuated from the inside so as to provide an option which will allow for prompt exit from a dwelling place by small children, older persons, and handicapped persons for whom exit may be difficult, and yet which also provides a secure lock so as to minimize the possibility of forcible entry. It would also be advantageous to have the option of using a key-actuated dead bolt to provide added security when wanted, and to also provide a security lock having an anti-lockout mechanism so that persons exiting the dwelling place with the lock in the locked position cannot lock themselves out if the key is forgotten.

The foregoing and other features and objects of the present invention are realized in the security lock and method which are disclosed and claimed herein. The security lock of the present invention comprises a latch positioned at the edge of a door which is actuated to selectively lock or unlock the door. The security lock also includes an optional key-actuated dead bolt which can provide additional security when desired. The mechanism for locking or unlocking the latch comprises a hand-actuated knob positioned on the inside of the door so that when the dead bolt is not used, the latch mechanism may still be locked or unlocked simply by rotating the knob between two positions. Thus, the knob may be used by children, older persons or handicapped persons to very quickly and easily unlock the latch mechanism without the need for a key when the dead bolt is not in use. This provides a significant added safety feature which has long been needed in the art.

An additional important feature is that the mechanism for locking the latch is disengaged when the latch is in the locked position. This means that a person attempting forcible entry may rotate the doorknob without in any way engaging the locked latch. Thus, even when the dead bolt is not in use, the latch cannot be forced open simply by applying excessive force to the doorknob, thereby providing important added safety.

Still another important feature of the security lock of the present invention is that the latch mechanism is designed so that if the door is open and the latch is in the locked position, when the door closes the latch is automatically unlocked. This means that small children or other persons who may leave their dwelling without a key will not be locked out since the only way to lock the security lock when leaving the dwelling is to lock the dead bolt using a key.

DETAILED DESCRIPTION OF THE PREFERRED EMBODIMENTS

Reference is now made to the drawings wherein like parts are designated with like numerals throughout.

Figure 1:
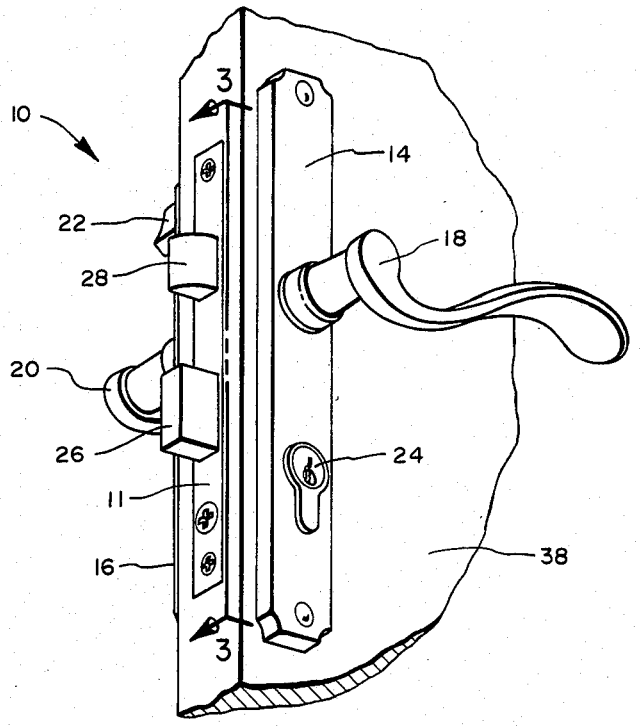
FIG. 1 illustrates a perspective view of one presently preferred embodiment of a security lock within the scope of the present invention, showing the lock from the outside of a door.
Figure 2:
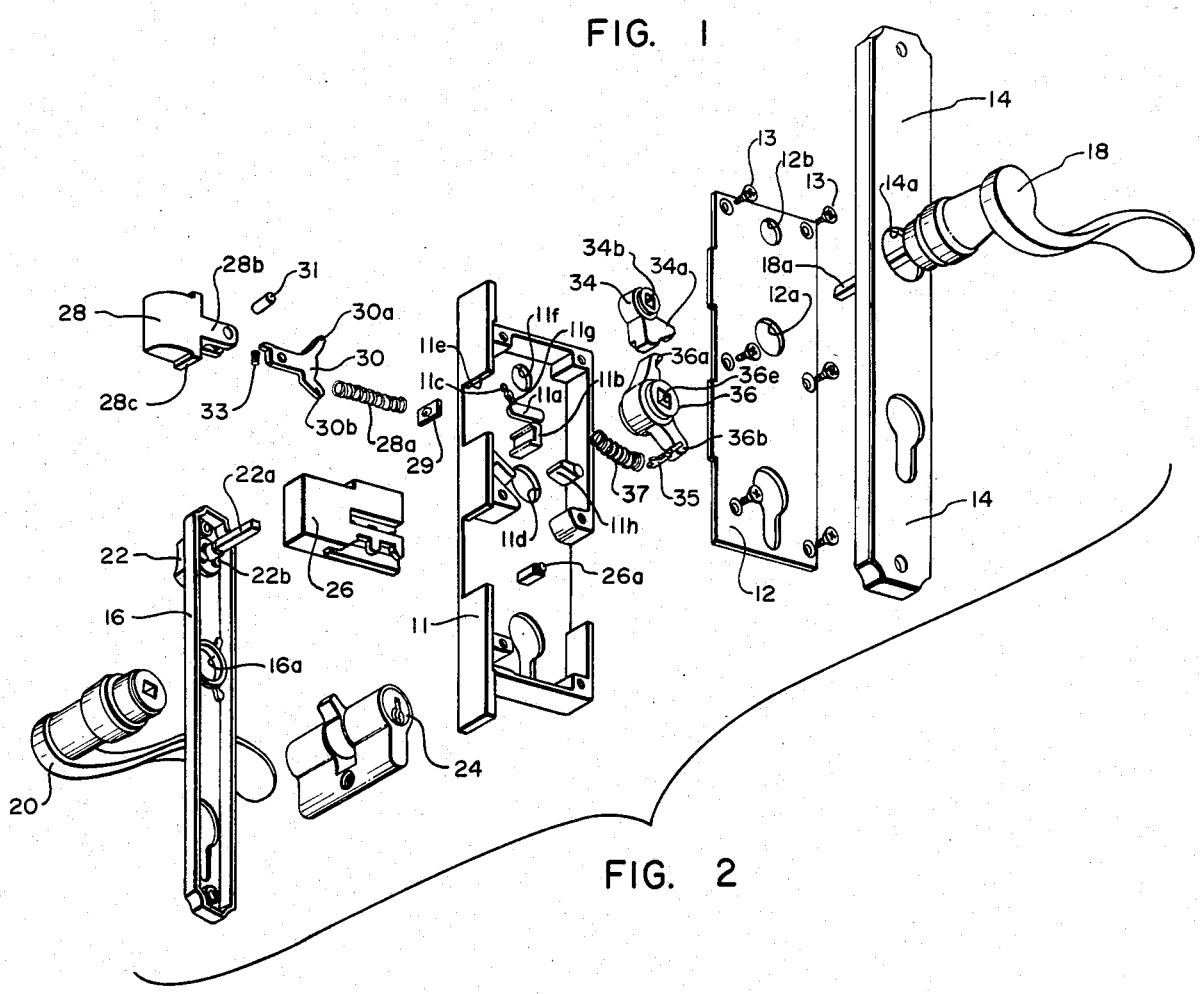
FIG. 2 represents an exploded perspective view of the presently preferred embodiment, showing more particularly the various components which are internal to the security lock.

Referring first to FIG. 1 and 2, security lock 10 includes a housing 11 which supports the internal components of the security lock 10. Formed on the base of housing 11 is a horizontal guideway 11*a* and a spring post 11*b*. Spring post 11*b* is adapted to receive the ends of a bifurcated extension member 28*b* of latch 28 (see FIG. 2) as will be explained in more detail hereinafter.

As shown best in FIG. 2, upon assembly of the component parts within housing 11, a cover plate 12 is attached to the top of housing 11 by a plurality of screws 13 or any other suitable means. The assembled components within housing 11 and cover plate 12 are then placed into a correspondingly shaped recess formed within the edge of a door 38, as illustrated best in FIGS. 1 and 1*a*. An exterior escutcheon 14 and an interior escutcheon 16 are placed on the surfaces of the door 38 facing the outside and inside of the dwelling, respectively.

With reference to FIG. 2, and exterior door handle 18 is positioned within a hole 14*a* in exterior escutcheon 14, while a corresponding interior door handle 20 is positioned within a hole 16*a* formed in interior escutcheon 16. A spindle 18*a* interconnects door handles 18 and 20 and extends through the security lock 10 by means of appropriately positioned holes 12*a* and 11*d* within cover plate 12 and housing 11, respectively.

A security knob 22 (shown best in FIG. 1*a*) is mounted on interior escutcheon 16 so as to be on the inside of door 38. As shown in FIG. 2, a square spindle 22*a* is attached to the knob 22, which is then secured to escutcheon 16 by the spring clip 22*b* (see FIGS. 2 and 5) placed on the inside of escutcheon 16 near the base of spindle 22*a*. The end of spindle 22*a* engages a square hole 34*b* formed through a spindle bolt 34, (see also FIG. 3). When rotated, knob 22 and spindle 22*a* rotate the spindle bolt 34. As hereinafter more fully explained, knob 22 and spindle bolt 34 provide a means for selectively locking or unlocking latch 28 from inside, without the need for a key. Also, as described in greater detail below, when locked, latch 28 will be disengaged from the outside door handle 18 and its spindle 18*a*, thus providing added safety from forcible entry by forcing door handle 18.

Referring again to FIGS. 1 and 2, a key-actuated lock cylinder 24 is also provided in the security lock 10 and allows for activation of a dead bolt 26 which is situated against a post 26*a* formed in housing 11. In this regard, it should be recognized that dead bolt 26 may comprise any conventional dead bolt assembly and is not limited to the configuration shown herein. In the presently preferred embodiment, dead bolt 26 is a double-throw bolt to provide maximum security when locked.

Figure 3:
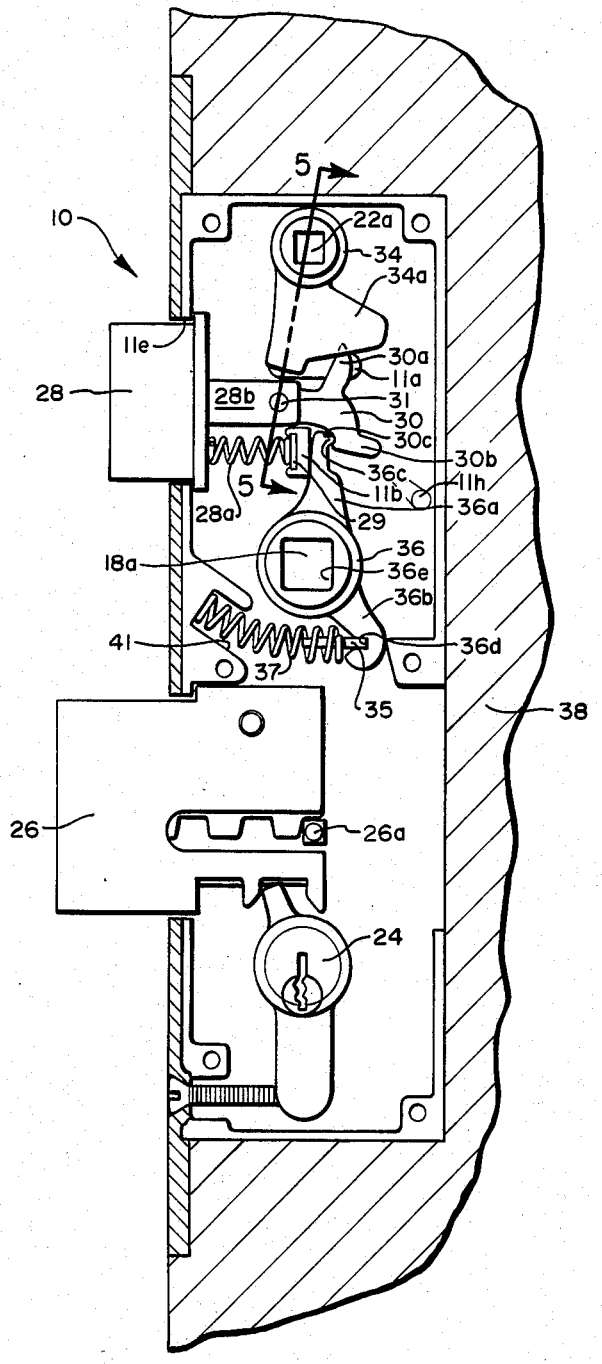
FIG. 3 is a cross-sectional view of the preferred embodiment of FIG. 1 taken along line 3—3 of FIG. 1, and shows the latch in an extended and unlocked position.

Referring next to FIGS. 2 and 3, the latch 28 is slidably positioned within a recess 11*e* formed in the side of housing 11. A bifurcated member 28*b* of latch 28 fits within a channel (see FIG. 3) formed between horizontal guideway 11*a* and spring post 11*b*. A spring 28*a* is positioned between the back of latch 28 and a dimpled plate 29 which is seated against spring post 11*b*. Spring 28*a* thus serves to bias latch 28 in an extended (i.e., latched) position. A peripheral lip 28*c* catches the edges of recess 11*e* and limits the extension of latch 28.

A lever member 30 having an upper arm 30*a* and a lower arm 30*b* is pivotally connected to the bifurcated extension member 28*b* by inserting the end of lever member 30 between the bifurcated portion of extension member 28*b* and inserting a pin 31 through corresponding holes formed in extension member 28*b* and lever member 30. The upper arm 30*a* of lever member 30 slides along and is supported by the horizontal guideway 11*a* of housing 11. A lever spring 33 (see FIG. 4) is positioned between a catch 30*d* on the end of lever member 30 and bifurcated extension member 28*b* so as to bias lever member 30 in a clockwise rotational direction (shown by arrow 39 of FIG. 4) away from arm 34*a* of spindle bolts 34. Rotational movement of lower arm 30*b* is limited in the clockwise direction of arrow 39 (FIG. 4) by a stop 11*h* formed on housing 11. This prevents lever member 30 from rotating too far and over compressing spring 37.

Figure 4:
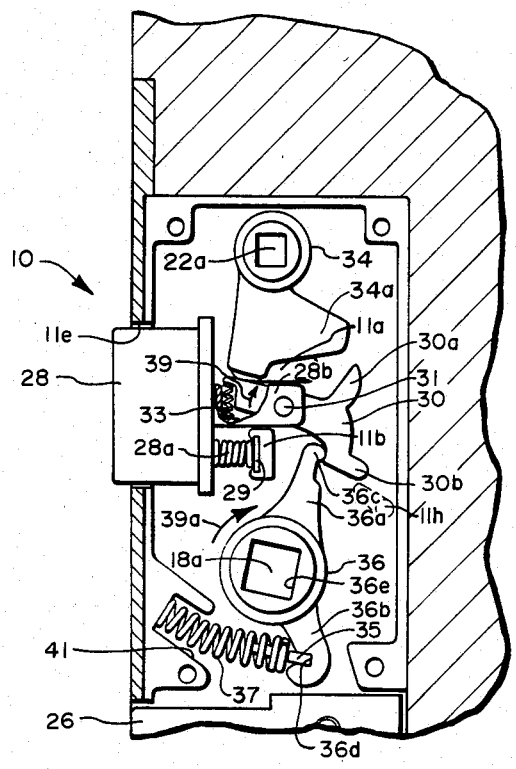
FIG. 4 is a partial cross-sectional view along line 3—3 of the embodiment of FIG. 1, and shows the security lock when the door handle is turned and the latch is retracted into the door.

A spindle bolt 36 having an upper arm 36*a* and a lower arm 36*b* is positioned inside of housing 11 as illustrated, for example, in FIG. 3. The square spindle 18*a* of door handle 18 engages a square hole formed in spindle bolt 36. Rotational movement of upper arm 36*a* in a counterclockwise direction is limited by the position of spring post 11*b*. Upper arm 36*a* of spindle bolt 36 has a catch 36*c* for engaging a notch 30*c* formed at the end of lower arm 30*b* of lever member 30. When door handle 18 and spindle 18*a* are rotated clockwise in the direction of arrow 39*a* (FIG. 4), catch 36*c* engages notch 30*c* and spindle bolt 36 is also rotated clockwise. Lever member 30 then rotates as shown at arrow 39 (FIG. 4) and retracts latch 28, moving it towards the right, thereby retracting latch 28 within the housing 11 as shown in FIG. 4.

A T-bar spring base 35 (see FIGS. 2 and 3) fits into a notch 36*d* formed in the end of lower arm 36*b* of spindle bolt 36. T-bar 35 supports one end of a spring 37, the other end of spring 37 being supported in a channel 41 formed in housing 11. Spring 37 tends to bias the spindle bolt 36 in a counterclockwise direction (i.e., opposite arrow 39*a*). Thus, spring 37 serves to release latch 28 so that it can return to the extended position (see FIG. 3) by means of spring 28*a*.

Figure 1A:
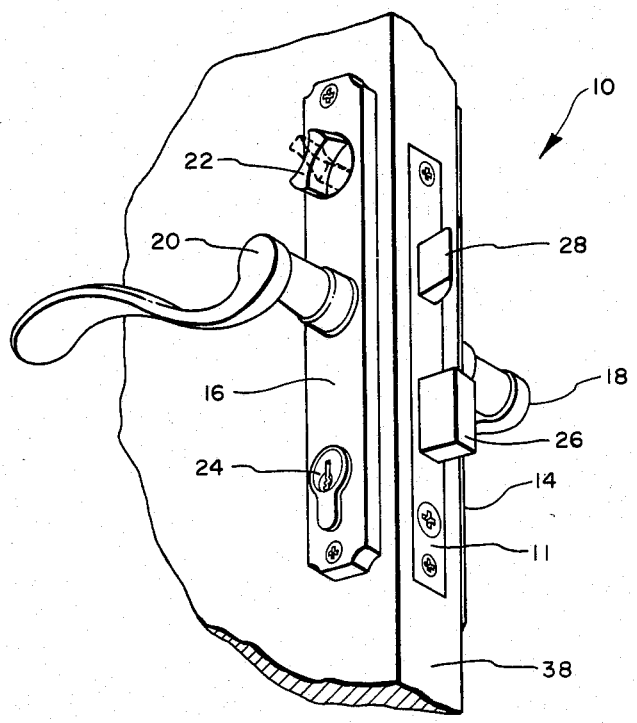
FIG. 1*a* illustrates a perspective view of the security lock of FIG. 1 showing the lock from the inside of the door.

As shown in FIG. 2, the spindle bolt 34 for security knob 22 is rotatably secured between holes 11*f* and 12*b* formed in housing 11 and cover plate 12, while the spindle bolt 36 for the door handles 18 and 20 is rotatably secured between holes 12*a* and 11*d*. Spindle bolt 34 (see FIGS. 6 and 7) has an arm 34*a* which also slides on and is supported by guideway 11*a* of housing 11. Arm 34*a* has a channel 34*b* cut into the underside of it which is adapted to receive the end of arm 30*a* on lever member 30. Arm 34*a* thus serves to selectively engage or disengage the upper arm 30*a* of lever member 30. When knob 22 is unlocked as shown in FIG. 1*a*, arm 34*a* (see FIG. 4) of spindle bolt 34 will disengage arm 30*a* of lever member 30, permitting the lower arm 30*b* of lever member 30 to be engaged by arm 36*a* of lower spindle bolt 36. Thus, when knob 22 is unlocked, latch 28 is engaged by the spindle bolt 36 of door handles 18 and 20 so that latch 28 can be extended or retracted to open or close the door 38.

Figure 6:
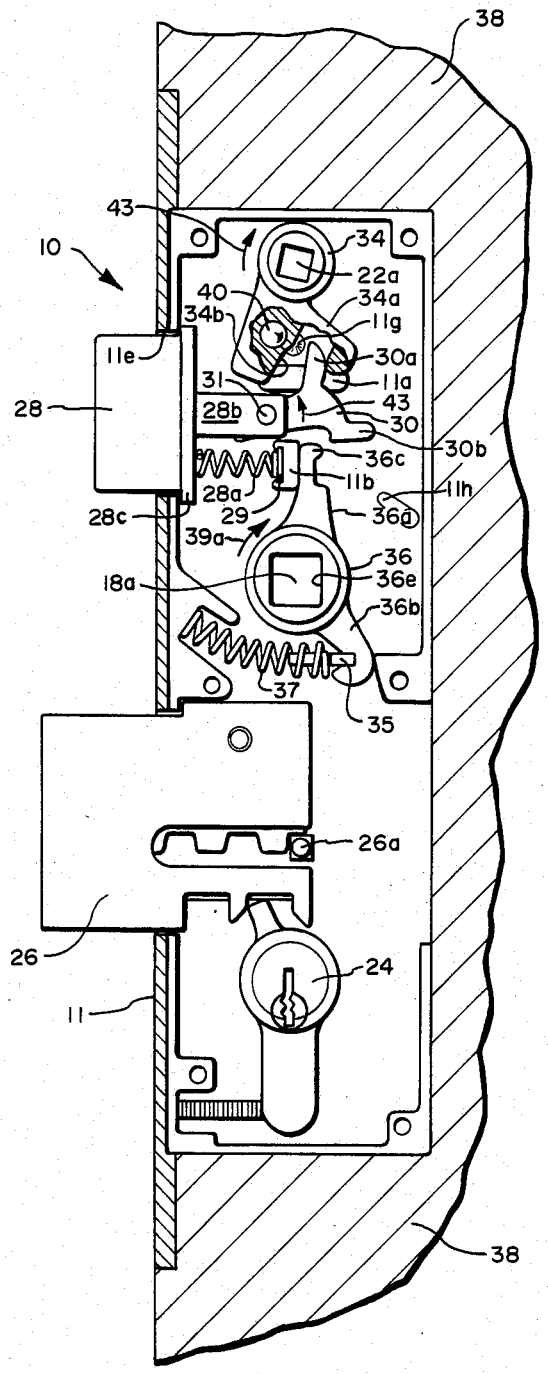
FIG. 6 is a further cross-sectional view taken along line 3—3 of the embodiment of FIG. 1, and shows the security lock when the latch is extended and locked, so as to be disengaged from the door handle.

When knob 22 is locked as shown by the phantom-line position in FIG. 1*a*, arm 34*a* slides over the end of upper arm 30*a* on lever member 30 (See FIGS. 3 and 6), thus engaging lever member 30 and rotating it counterclockwise (see arrow 43 of FIG. 6) about pin 31. This causes the lower arm 30*b* to be rotated up and away as shown in FIG. 6 so that arm 30*b* of lever member 30 cannot be engaged by catch 36*c* of spindle bolt 36. Thus, when knob 22 is in the locked position, door handles 18 and 20 can rotate clockwise (arrow 39*a*) without engaging the lever member 30 of latch 28. This advantageously prevents the latch 28 from being forced by applying excess force to door handle 18. However, note that latch 28 can still be quickly and safely unlocked without a key simply by operating knob 22. Thus, this prevents small children, older persons or handicapped persons from becoming trapped inside if a key is not found, so long as the dead bolt 26 is not locked. If additional security is desired, however, the key-actuated dead bolt may be locked, as shown in FIG. 6, or unlocked, as shown in FIG. 7, using the key-actuated locking cylinder 24.

Figure 5:
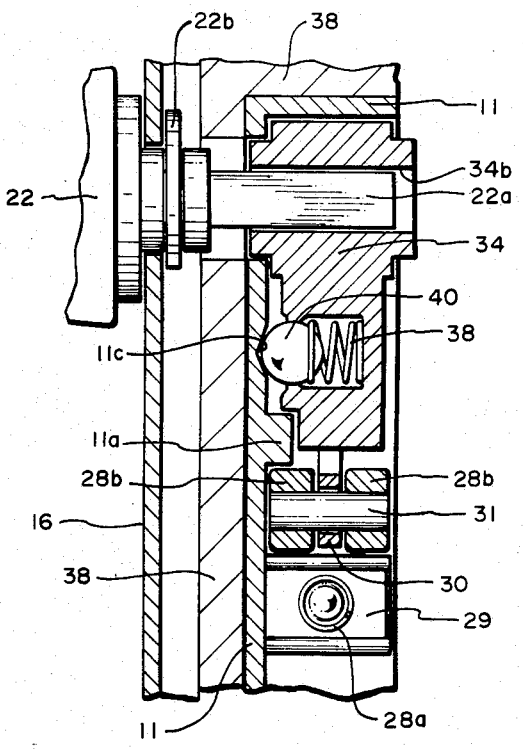
FIG. 5 is a cross-sectional view of the embodiment of FIG. 3 taken along line 5—5 of FIG. 3.
Figure 7:
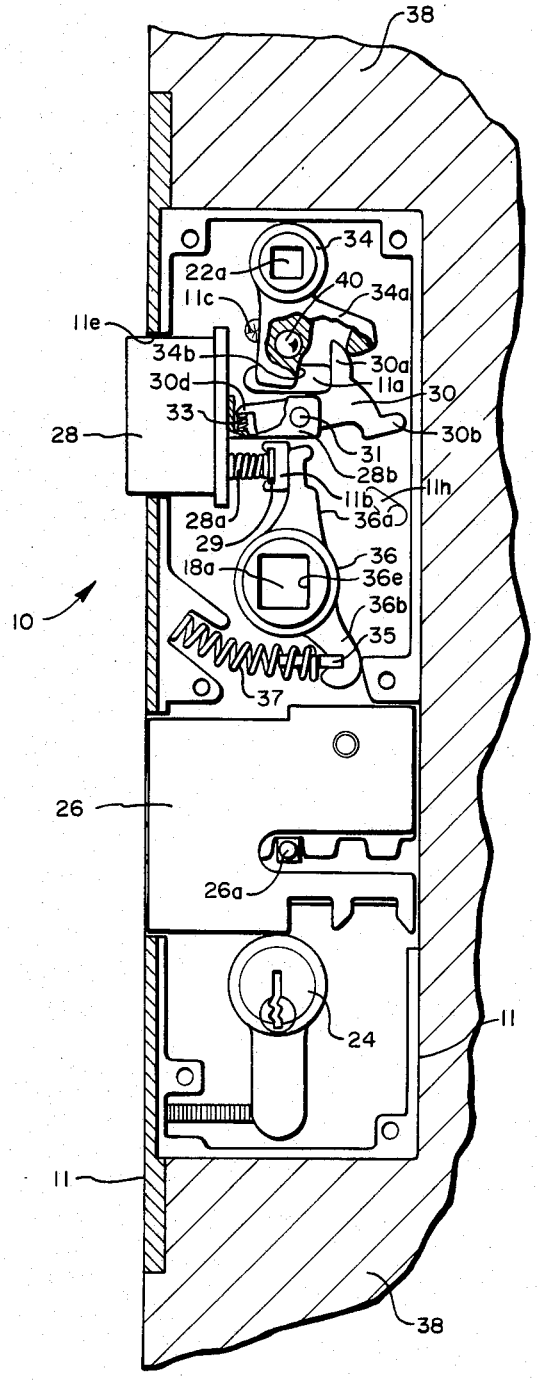
FIG. 7 is a cross-sectional view similar to FIG. 6, showing how the latch is automatically unlocked as the door is closed so as to provide an anti-lockout feature.

To releasably secure spindle bolt 34 in the locked and unlocked positions, a spring 28 and ball bearing 40 are preferably mounted under arm 34*a* as best shown in FIGS. 5–7. Further, as best seen in FIG. 2, a pair of indentations or impressions 11*c* and 11*g* are formed in the base of housing 11 to accommodate ball bearing 40 at the locked and unlocked positions of arm 34*a*, respectively. Thus, as shown in FIGS. 5 and 6, ball bearing 40 is held by spring 38 in indentation 11*c* when knob 22 is locked, and is moved from indentation 11*c* to indentation 11*g* (see FIG. 7) when knob 22 is moved to the unlocked position.

The interaction and operation of the components of security lock 10 of the present invention will now be explained with reference to the drawings. Referring first to FIG. 3, the latch 28 is shown in its normally extended position. Thus, with the various components arranged as shown in FIG. 3, latch 28 is activated by turning handle 18 or handle 20 in the direction of arrow 39*a* in FIG. 4.

Upon rotation, upper arm 36*a* of spindle bolt 36 engages lower arm 30*b* of lever member 30, thus rotating and displacing lever member 30 towards the right as shown in FIG. 4. As lever member 30 is displaced, it pulls on the pin 31 secured to the bifurcated extension member 28*b* and thus slides latch 28 to the right, thereby retracting latch 28 within the door.

Upon release of door handle 18 or 20 spring 37 (which has been compressed as shown in FIG. 4) pushes against the lower arm 36*b* of lower spindle bolt 36, rotating it counterclockwise so as to restore it back to its original position, shown in FIG. 3. At the same time, spring 28*a* serves to restore latch 28 back to its original unretracted position, also shown in FIG. 3. Thus, spindle bolt 36 and lever member 30, in conjunction with springs 37 and 28*a*, serve to provide the primary components for actuating latch 28 so as to selectively extend or retract the latch to lock or unlock the door, as desired.

In the arrangement shown in both FIGS. 3 and 4, the upper spindle bolt 34 of security knob 22 is positioned so as to allow engagement and operation of the lever member 30 by lower spindle bolt 36 operated by the door handles. Thus knob 22 is unlocked. However, by locking knob 22 (see the phantom-line position of knob 22 in FIG. 1*a*), spindle bolt 34 is rotated in the clockwise direction (arrow 43 of FIG. 6) so that arm 30*b* of lever member 30 is completely disengaged from arm 36*a* of lower spindle bolt 36. Thus, in this position as shown in FIG. 6, the latch 28 may not be retracted within the door.

In this regard, it will be noted that if handle 18 or 20 is turned so as to rotate spindle bolt 36 in the clockwise direction, it will merely rotate freely and will not engage lower arm 30*b* of lever member 30. Thus, the door handle will swing freely with spring 37 restoring the handle to its original position without any actuation or sliding of latch 28. Hence, any attempt to force door handle 18 or 20 while security lock 10 is in the locked position as shown in FIG. 6 will not structurally disturb latch 28, which will remain in the locked, extended position.

In order to unlock the latch 28, knob 22 is turned so as to rotate spindle 22*a* and spindle bolt 34 in the counterclockwise direction. Upon counterclockwise rotation of spindle bolt 34, upper arm 30*a* of lever member 30 is released from the channel 34*b* of arm 34*a* and spring 33 (FIG. 4) rotates lower arm 30*b* of lever member 30 in a clockwise direction back into engagement with upper arm 36*a* of lower spindle bolt 36. Latch 28 can then be actuated by the door handles.

Referring now to FIGS. 6–7, the anti-lockout feature of the present invention is next explained. In FIG. 6, upper spindle bolt 34 has been rotated so as to lock the lever member 30 so that lower arm 30*b* cannot be engaged by arm 36*a* of lower spindle bolt 36. Knob 22 is thus in the locked position. However, as shown in FIG. 7, even when so locked, upon closing the door, latch 28 will be retracted within the door when contacting the striker plate (not shown) on the door jamb (not shown). Upon retraction of latch 28, bifurcated extension member 28*b* is moved to the right as shown in FIG. 7, displacing lever member 30 to the right. As lever member 30 is so displaced, upper arm 30*a* of lever member 30 puts pressure against arm 34*a* of upper spindle bolt 34 so as to rotate the arm 34*a* in a counterclockwise direction, restoring spindle bolt 34 to its unlocked position.

Spring 33 then forces lever member 30 back to its original position, shown in FIGS. 3 and 4, by rotating lever member 30 in a clockwise direction as upper arm 30*a* of lever member 30 is released by arm 34*a* of spindle bolt 34. Hence, the lever member 30 of latch 28 is then engaged by lower spindle bolt 36, allowing the person who shut the door to actuate latch 28 by turning handle 18 or 20.

Thus, it will be seen that the configuration and operation of the components of security lock 10 prevent a person from locking himself out of the dwelling even when the latch 28 is locked by knob 22, since shutting the door will automatically serve to unlock the latch 28.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Pattent is:

1. A security lock for selectively locking or unlocking a door, said security lock comprising:

latch means connected to door handles which are adapted to be located on the inside and outside of said door, said latch means comprising means for securing said door in a closed position;

security means for selectively locking and unlocking said latch means comprising a hand-actuated member adapted to be located on the inside of said door, said member being operable between locked and unlocked positions to selectively lock and unlock said latch means said security means being disconnected from said door handles in the locked position and said security means further comprising means for disengaging said latch means from said door handles when said member is operated so as to lock said latch means thereby permitting free rotational displacement of said door handles; and said latch means further comprising means for automatically unlocking said security means when said latch means is moved to a fully retracted position causing said hand-actuated member to move from a position to an unlocked position;

whereby when said security means is in a locked position and the door is subsequently closed, the security means is automatically unlocked thereby preventing accidental lock-out.

2. A security lock as defined in claim 1 further comprising a dead bolt and means for selectively locking and unlocking said dead bolt independently of said latch means.

3. A security lock as defined in claim 1 further comprising actuating means for engaging and retracting said latch means when one of said door handles is turned so as to open said door.

4. A security lock as defined in claim 3 wherein said means for disengaging said latch means from said door handles comprises means for disengaging said latch means from said actuating means when said member is in said locked position.

5. A security lock as defined in claim 4 wherein:

said security means comprises a first spindle bolt rotatably connected to said hand-actuated member by a first spindle, and a first arm rotatably connected to said first spindle bolt, wherein said actuating means comprises a second spindle bolt rotatably connected to said door handles by a second spindle, and a second arm rotatably connected to said second spindle bolt; wherein said latch means comprises a door latch slidably mounted in a housing, and a lever member pivotally connected to said door latch, said lever member comprising an upper arm for selectively engaging said first arm, and a lower arm for selectively engaging said second arm; and whereby when said hand-actuated member is in said locked position said upper arm is engaged by said first arm so as to rotate said lever member so that said lower arm is disengaged from said second arm; and when said hand-actuated member is in said unlocked position said lower arm is engaged by said second arm so as to slidably retract said door latch when one of said door handles is turned.

6. A security lock as defined in claim 5 wherein said means for automatically unlocking said security means comprises means for engaging said lower arm with said second arm when said door is closed with said hand-actuated member in said locked position.

7. A security lock as defined in claim 6 wherein said latch means further comprises a spring member for rotatably biasing said lever member such that when said door latch is retracted into said housing said upper arm of said lever member is rotated so as to disengage said first arm, and said lower arm is rotated into engagement with said second arm.

8. A security lock as defined in claim 5 further comprising means for releasably holding said security means in said locked and unlocked positions.

9. A security lock as defined in claim 8 wherein said means for releasably holding said security means in said locked and unlocked position comprises:

a spring member positioned under said first arm of said first spindle bolt;

a ball bearing held in one end of said spring member so as to bias said ball bearing against said housing; and a pair of indentations formed in said housing for receiving said ball bearing, one indentation defining said locked position when said first spindle bolt is rotated so as to move said ball bearing into said one indentation, and the other indentation defining said unlocked position when said first spindle bolt is rotated so as to move said ball bearing into said other indentation.

10. A security lock as defined in claim 5 further comprising means for biasing said latch means in an extended, latched position.

11. A security lock as defined in claim 10 wherein said means for biasing said latch means comprises:

a first spring member for forcibly urging said door latch into said extended, latched position; and a second spring member for rotatably urging said second spindle bolt to a position where said lever member accommodates said extended, latched position of said door latch.

12. A security lock as defined in claim 11 wherein said housing comprises a spring post and wherein said first spring member is secured between said door latch and said spring post.

13. A security lock as defined in claim 12 wherein said housing further comprises a guideway for slidably supporting said first arm and said second upper arm of said lever member, and wherein said door latch and said lever member are slidably positioned between said spring post and said guideway.

14. A security lock for selectively locking or unlocking a door, said security lock comprising:

door handles located on the inside and outside of said door;

latch means for securing said door when closed;

actuating means for engaging and retracting said latch means when one of said door handles is turned so as to open said door;

security means for selectively locking and unlocking said latch means, said security means comprising a hand-actuated member on the inside of said door, and a first spindle bolt rotatably connected to said hand-actuated member by a first spindle, and a first arm rotatably connected to said first spindle bolt, said hand-actuated member being rotatable from a locked to an unlocked position and viceversa, and means connected to said member for disengaging said latch means from said actuating means when said member is in said locked position;

said actuating means comprising a second spindle bolt rotatably connected to said door handles by a second spindle, and a second arm rotatably connected to said second spindle bolt;

a dead bolt and means for selectively locking and unlocking said dead bolt independently of said latch means; and said latch means comprising a door latch slidably mounted in a housing, and a lever member pivotally connected to said door latch, said lever member comprising an upper arm for selectively engaging said first arm, and a lower arm for selectively engaging said second arm, such that when said hand-actuated member is in said locked position said upper arm is engaged by said first arm so as to rotate said lever member so that said lower arm is disengaged from said second arm, and when said hand-actuated member is in said locked position said lower arm is engaged by said second arm so as to slidably retract said door latch when one of said door handles is turned.

15. A security lock as defined in claim 14 wherein said latch means comprises means for automatically unlocking said security means and engaging said actuating means when said door is closed with said hand-actuated member in said locked position so as to prevent accidental lockout.

16. A security lock as defined in claim 15 further comprising means for biasing said latch means in an extended, latched position.

17. A security lock as defined in claim 16 further comprising means for releasably holding said security means in said locked and unlocked positions.

18. A security lock as defined in claim 17 wherein said means for biasing said latch means comprises:

a first spring member for forcibly urging said door latch into said extended, latched position; and a second spring member for rotatably urging said second spindle bolt to a position where said lever member accommodates said extended, latched position of said door latch.

19. A security lock as defined in claim 18 wherein said housing comprises a spring post and wherein said first spring member is secured between said door latch and said spring post.

20. A security lock as defined in claim 19 wherein said housing further comprises a guideway for slidably supporting said first arm and said upper arm of said lever member, and wherein said door latch and said lever member are slidably positioned between said spring post and said guideway.

21. A security lock as defined in claim 20 wherein said latch means further comprises a third spring member for rotatably biasing said lever member such that when said door latch is retracted into said housing said upper arm of said lever member is rotated so as to disengage said first arm, and said lower arm is rotated into engagement with said second arm.

22. A security lock as defined in claim 21 wherein said means for releasably holding said security means in said locked and unlocked positions comprises:

a spring member positioned under said first arm of said first spindle bolt;

a ball bearing held in one end of said spring member so as to bias said ball bearing against said housing; and a pair of indentations formed in said housing for receiving said ball bearing, one indentation defining said locked position when said first spindle bolt is rotated so as to move said ball bearing into said one indentation, and the other indentation defining said unlocked position when said first spindle bolt is rotated so as to move said ball bearing into said other indentation.

23. A security lock for selectively locking or unlocking a door, said security lock comprising:

door handles which are adapted to be located on the inside and outside of said door;

latch means for securing said door when closed;

actuating means for engaging and retracting said latch means when one of said door handles is turned so as to open said door;

security means for selectively locking and unlocking said latch means, said security means comprising a hand-actuated member adapted to be located on the inside of said door, said member being rotatable from a locked to an unlocked position and vice-versa, and means connected to said member for disengaging said latch means from said actuating means when said member is in said locked position thereby permitting free rotational displacement of said door handles;

a dead bolt and means for selectively locking and unlocking said dead bolt independently of said latch means; and said latch means comprising means for automatically unlocking said security means and engaging said actuating means when said door is closed with said hand-actuated member in said locked position so as to prevent accidental lockout.

24. A security lock comprising:

a latch positioned at the edge of a door;

a door handle mounted exterior to the door;

means, interconnecting said latch and said door handle, for slidably actuating said latch relative to the door when said door handle is turned, said means comprising:

a first spindle;

a first spindle bolt having an arm formed thereon, said spindle being mounted to said door handle at one end thereof and to said spindle bolt at the other end thereof; and a lever member having a first arm and a second arm formed thereon, said lever member being rotatably connected to said latch, said first spindle bolt arm being adapted to engage said first lever member arm such that said latch is slidably displaced when said first spindle bolt arm displaces first said lever arm; and means for selectively engaging and disengaging said actuating means such that said latch will slide when said actuating means is engaged and said door handle is turned and such that said latch will remain stationary when said actuating means is disengaged and said door handle is turned, said means for selectively engaging and disengaging said actuating means comprising means for rotating said lever member to a position where said first spindle bolt arm is not capable of engaging said first lever member arm, said means for rotating said lever member comprising:

a knob placed on the inside of the door;

a second spindle bolt which is rotatable and has an arm formed thereon; and a second spindle interconnecting said knob and said second spindle bolt, said second spindle bolt arm being capable of engaging said second lever member arm and rotating said lever member when said knob is turned.

25. A security lock as defined in claim 24 further comprising:

means for biasing said latch in an extended, latched position;

means for biasing said first spindle bolt arm away from said first lever member arm; and means for biasing said second lever member arm away from said second spindle bolt arm.

26. A security lock as defined in claim 24 further comprising:

a housing containing said means for actuating said latch and containing said means for selectively engaging and disengaging said actuating means;

a ball bearing associated with said second spindle bolt;

means for biasing said ball bearing against said housing; and a plurality of indentations formed in said housing to releasably hold said ball bearing at different positions of the second spindle bolt.

27. A security lock as defined in claim 24 wherein said means for selectively engaging and disengaging said actuating means includes means for engaging said actuating means whenever said latch is retracted within the door, thereby protecting against accidental lockout, and wherein said security lock further comprises a dead bolt assembly mounted to the door for providing additional security, said dead bolt assembly functioning independently of said latch.

* * * * *

UNITED STATES PATENT AND TRADEMARK OFFICE

CERTIFICATE OF CORRECTION

PATENT NO. : 4,648,639

DATED : March 10, 1987

INVENTOR(S) : Eugene W. Martin et al.

It is certified that error appears in the above-identified patent and that said Letters Patent is hereby corrected as shown below:

Column 4, line 18, "over compressing" should be --overcompressing--
Column 4, line 19, "spindle bolt 36" should be --second spindle bolt 36--
Column 8, line 55, "viceversa" should be --vice versa--
Column 10, lines 11-12, "vice-versa" should be --vice versa--
Column 10, line 44, "first said" should be --said first--

Signed and Sealed this

Eighteenth Day of August, 1987

*Attest:*

*Attesting Officer*

DONALD J. QUIGG

*Commissioner of Patents and Trademarks*